US007305741B2

(12) United States Patent
Joe

(10) Patent No.: US 7,305,741 B2
(45) Date of Patent: Dec. 11, 2007

(54) BINDER CLIP

(76) Inventor: Yeong-Gi Joe, Samsung Raemian Apt 106-604, Guro 3-dong 256-1, Guro-gu, Seoul (KR)

( * ) Notice: Subject to any disclaimer, the term of this patent is extended or adjusted under 35 U.S.C. 154(b) by 12 days.

(21) Appl. No.: 11/308,047

(22) Filed: Mar. 3, 2006

(65) Prior Publication Data

US 2007/0175002 A1 Aug. 2, 2007

(30) Foreign Application Priority Data

Jan. 31, 2006 (KR) ..... 10-2006-0009342
Feb. 17, 2006 (KR) ..... 10-2006-0015585

(51) Int. Cl.
*B42F 1/06* (2006.01)

(52) U.S. Cl. ..... 24/67.5; 24/558

(58) Field of Classification Search ..... 24/67 R, 24/67.3, 67.5, 67.9, 67.11, 546, 547, 558, 24/DIG. 8, DIG. 9, DIG. 10
See application file for complete search history.

(56) References Cited

U.S. PATENT DOCUMENTS 5,896,624 A * 4/1999 Horswell ..... 24/67.5

FOREIGN PATENT DOCUMENTS

JP 08020182 A * 1/1996
JP 2002048113 A * 2/2002
JP 2002048114 A * 2/2002

* cited by examiner

*Primary Examiner*—James R Brittain
(74) *Attorney, Agent, or Firm*—ILPA P.A.; James E. Bame

(57) ABSTRACT

A binder clip, having a structure that removably binds several sheets of documents rotating and pressing hinged pressing levers that function to open or close the mouth of a clip body, thereby binding the documents prior to keeping them in a desired place, is disclosed. The binder clip has a clip body. A coupling guide, formed as a U-shaped frame body, is placed outside each of upper and lower surfaces of the clip body, with a locking projection provided at each end of the U-shaped coupling guide in order to be seated in the pocket. A pair of hinge holes is formed on opposite positions of the inner surface of the coupling guide. A plate-type pressing lever is formed as a plate-shaped body having a hinge hole so that the pressing lever is hinged to the hinge holes of the coupling guide using a hinge pin.

7 Claims, 6 Drawing Sheets

BINDER CLIP

BACKGROUND OF THE INVENTION

1. Field of the Invention

The present invention relates, in general, to binder clips and, more particularly, to a binder clip having a structure that removably binds several sheets of documents or papers by rotating and pressing hinged pressing levers that function to open or close the mouth of a clip body, thereby binding the documents or papers prior to keeping them in a desired place.

2. Description of the Related Art

Generally, a variety of clips have been used as tools to bind documents or papers, according to the type, thickness and binding method. When the document sheets to be filed are not so thick, Nalclip® clips have been preferably used.

The Nalclip® clips must be used with a clip dispenser specially designed for them. That is, to use the Nalclip® clips to bind a document, at least one clip is installed in the clip dispenser, and the jaws formed at the front end of the dispenser are positioned over arranged edges of the document sheets. Thereafter, a finger-operated handle of the dispenser is pushed forwards, so that a clip is moved forwards and is fitted over the edges of the document sheets prior to clipping the sheets. However, because of a limitation in a pushing force provided by a user and inherent limitations of the clip, such as the size of the clip dispenser, the size of the Nalclip® clips is limited to small sizes. Thus, when the document to be bound is beyond a predetermined thickness, the Nalclip® clip cannot be used.

To solve this problem, a conventional binder clip illustrated in FIG. 1 has been used, having a clip body 10, upper and lower jaws 11, an elastic web 12 and pressing levers 13.

The pressing levers 13, made from steel wires, are respectively locked to the upper and lower sides of the clip body 10. Each of the pressing levers 13 is made using a steel wire to form an appropriate shape having arms allowing a user to easily press the levers with his/her fingers. The ends of opposite arms of each pressing lever 13 are horizontally and oppositely directed outwards. The ends of each pressing lever 13 are hinged to the jaws 11 of the clip body 10.

The clip body 10 has a triangular cross-section with three sides, which are an upper side, a web side and a lower side. The clip body 10 includes the upper and lower jaws 11, to which the pressing levers 13 are respectively locked, with the elastic web 12 connected to the upper and lower surfaces of the clip body 10 and forming a web surface to provide predetermined elasticity to the jaws 11.

A mouth 14 is formed between the jaws 11 so that the mouth 14 forms an opening when the jaws 11 are levered upwards and downwards to clip document sheets. The upper and lower edges of the mouth 14 are roundly curled upwards and downwards, respectively, and the intermediate portion of each edge of the mouth 14 is cut to form insert openings, whereby the outwardly bent opposite ends of each pressing lever 13 can be hinged to the curled edges through the insert openings.

If the upper and lower pressing levers 13 of the clip body 10 are pressed by a user's fingers under the condition that the upper and lower pressing levers 13 are locked to the jaws 11, the elastic web 12 elastically and inwardly bulges while the mouth 14 is elastically opened. In the above state, the opening extent of the jaws 11 is dependent upon the bending strength of the elastic web 12. Advantageously, this type of clip provides a high clipping force to compress and clip document sheets, and thus a thick document can be bound by the clip.

However, the conventional binder clip having the above-described structure requires that a user press the pressing levers 13 with his/her fingers, which requires a strong pressing force while manipulating the levers 13. In an extreme case, this may cause the user to feel pain in the fingers, thereby being inconvenient to users. Furthermore, the pressing levers 13 of the binder clip project upwards and downwards, so that, when a document is bound using the clip, the levers 13 protrude from the upper and lower surfaces of the document, thus being inconvenient to users stacking up or keeping a plurality of clipped documents in a desired place. In an effort to solve the problem, the pressing levers 13 may be separated from the clip body, however, it is very difficult to separate the levers from the clip body and assemble them therewith. Further, the pressing levers may be easily lost after separation.

SUMMARY OF THE INVENTION

Accordingly, the present invention has been made keeping in mind the above problems occurring in the related art, and an object of the present invention is to provide a binder clip, in which the pressing levers are configured so that they do not protrude, thus being convenient to users when stacking up and keeping a plurality of documents bound by clips in one place, the pressing levers being opened from associated coupling guides with a large angle between them and being formed to have a plate shape having a large surface, so that a user can open the jaws of the clip by manipulating the pressing levers with a small force without feeling pain in his/her fingers, unlike conventional binder clips, and which has a good appearance that is attractive to users by providing letters, patterns, embossments, perforations, mesh, figures or photographs on the upper and lower surfaces of each plate-type pressing lever.

In order to accomplish the above object, the present invention provides a binder clip comprising: a clip body formed by bending a sheet to have a triangular cross-section, comprising open opposite sides, upper and lower jaws respectively having upper and lower pockets at front ends thereof, and an elastic web connected to the rear ends of the jaws in order to provide elasticity to the clip body, so that the jaws are levered upwards and downwards by bending strength of the elastic web, thus opening a mouth of the clip body; a coupling guide formed as a U-shaped frame body having a predetermined thickness and placed outside each of upper and lower surfaces of the clip body, with a locking projection provided at each end of the U-shaped coupling guide in order to be seated in the pocket of an associated jaw, and a pair of hinge holes formed on opposite positions of an inner surface of a rear part of the coupling guide; and a plate-type pressing lever formed as a plate-shaped body having a hinge hole in one end thereof so that the pressing lever is hinged to the hinge holes of the coupling guide using a hinge pin, thus being rotatable around the hinge pin in order to be opened or closed relative to the coupling guide.

The front ends of the upper and lower jaws may be angularly bent to form the pockets having a rectangular cross-section; and the coupling guide may have a rectangular cross-section having outer surfaces corresponding to inner surfaces of each of the pockets of the clip body.

The plate-type pressing lever may further comprise: a thick part provided on the lower surface of the pressing lever and having both a surface area and a thickness corresponding to a space inside the U-shaped coupling guide.

The plate-type pressing lever may further comprise: at least one rib provided on the lower surface of the pressing lever and having both a width and a thickness corresponding to a space inside the U-shaped coupling guide.

The plate-type pressing lever may be provided on upper and lower surfaces thereof with letters, patterns, embossments, perforations, mesh, figures or photographs.

The plate-type pressing lever may be provided with a hanging hole formed vertically through the pressing lever at a predetermined position.

Each of the jaws may be provided with a clamping protrusion and a clamping groove.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
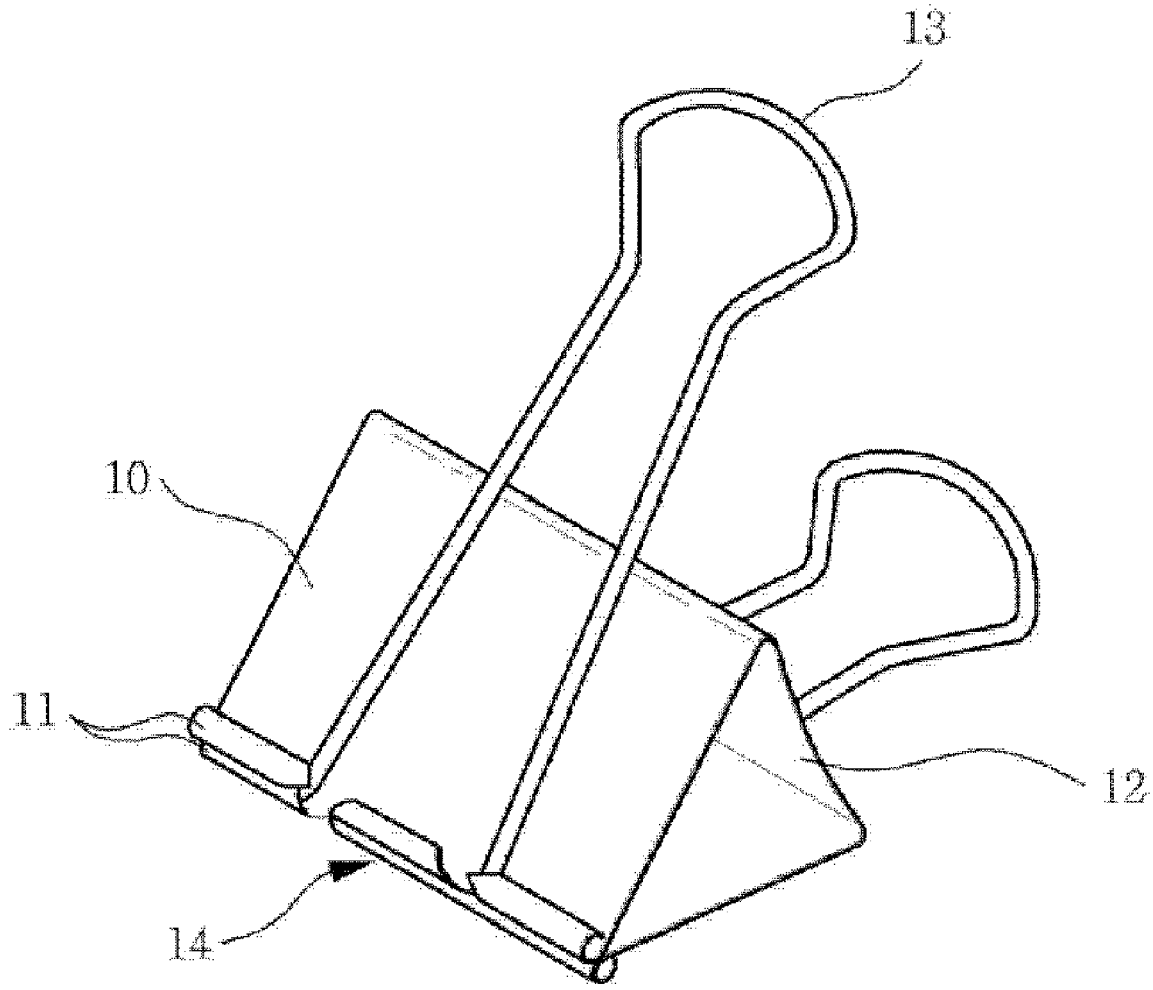
FIG. 1 PRIOR ART
FIG. 1 is a perspective view illustrating the construction of a conventional binder clip.

Reference will now be made in greater detail to preferred embodiments of the invention, examples of which are illustrated in the accompanying drawings. Wherever possible, the same reference numerals will be used throughout the drawings and the description to refer to the same or like parts.

Figure 2:
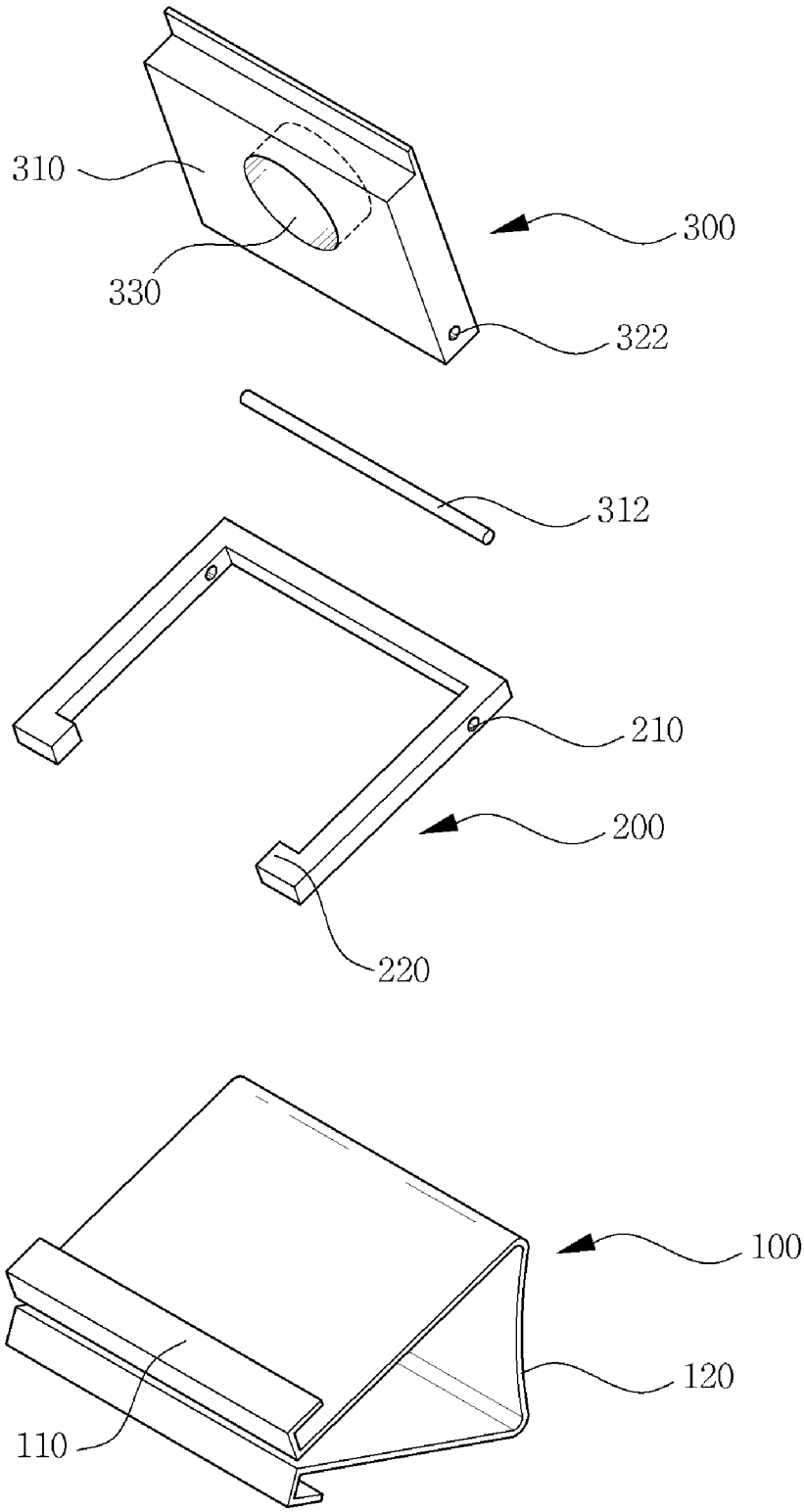
FIG. 2 is an exploded perspective view illustrating the construction of a binder clip according to a first embodiment of the present invention.

FIG. 2 is an exploded perspective view illustrating the construction of a binder clip according to a first embodiment of the present invention. As shown in FIG. 2, the binder clip 1 of the present invention comprises a clip body 100, two coupling guides 200 and two pressing plates 300.

The clip body 100 is formed by bending a sheet to have a triangular cross-section, comprising open opposite sides, upper and lower jaws 110 respectively having upper and lower pockets at front ends thereof, and an elastic web 120 connected to the rear ends of the jaws in order to provide elasticity to the clip body 100.

To bind document sheets using the binder clip, the jaws 110 are levered upwards and downwards by bending strength of the elastic web 120, thus opening the mouth 130 of the clip body 100.

Each of the coupling guides 200 is formed as a U-shaped frame body having a predetermined thickness and is placed outside each of the upper and lower surfaces of the clip body 100, with a locking projection 220 provided at each end of the U-shaped coupling guide 200 in order to be seated in the pocket of an associated jaw 110.

In the embodiment, the front ends of the upper and lower jaws 110 are angularly bent to form the pockets having a rectangular cross-section. Each of the coupling guides 200 or the locking projection 220 of the guide 200 preferably has a rectangular cross-section having outer surfaces corresponding to the inner surfaces of each of the pockets of the jaws 110. Due to the above-mentioned structure, the coupling guides 200 can be stably seated on the clip body 100.

A pair of hinge holes 210 is formed on opposite positions of the inner surface of a rear part of each coupling guide 200, which is opposite to the locking projections 220, so that a hinge pin 312 is inserted into the hinge holes 210 to hinge the pressing lever 300 to the coupling guide 200 as will be described in detail later herein.

Each of the pressing levers 300 is formed as a plate-shaped body having a hinge hole 322 in one end thereof, so that the pressing lever 300 is hinged to the hinge holes 210 of the coupling guide 200 using the hinge pin 312. Because the hinge pin 312 is rotatably inserted into the hinge holes 210, the pressing lever 300 is rotatable around the hinge pin 312 in order to be opened or closed relative to the coupling guide 200.

Each of the plate-type pressing levers 300 preferably further includes a thick part 310 on the lower surface thereof. The thick part 310 of the pressing lever 300 has both a surface area and a thickness corresponding to a space inside the U-shaped coupling guide 200. Because the thick part 310 acts as a means for increasing the strength of the pressing lever 300, the pressing lever 300 can resist high impact.

However, it should be understood that the structure of the means for increasing the strength of the pressing lever 300 is not limited to the thick part 310. For example, at least one rib (not shown), which has both a width and a thickness corresponding to the space inside the U-shaped coupling guide 200, may be provided on the lower surface of the pressing lever 300 in place of the thick part 310.

In addition, each of the coupling guides 200 and the plate-type pressing levers 300 is preferably made of a light material, such as a glass fiber, a carbon fiber or aluminum, thus reducing the weight of the binder clip in comparison with a conventional product. Furthermore, the binder clip of the present invention preferably has a good appearance that is attractive to users by providing letters, patterns, embossments, perforations, mesh, figures or photographs on the upper and lower surfaces of each plate-type pressing lever 300.

Each of the plate-type pressing levers 300 is preferably provided with a hanging hole 330, which is formed vertically through the pressing lever 300 at a predetermined position. Document sheets bound by the clip may be hung on a nail or a pin, driven in a wall or a desk, through the hanging hole 330, so that the binder clip is convenient to users.

Figure 3A:
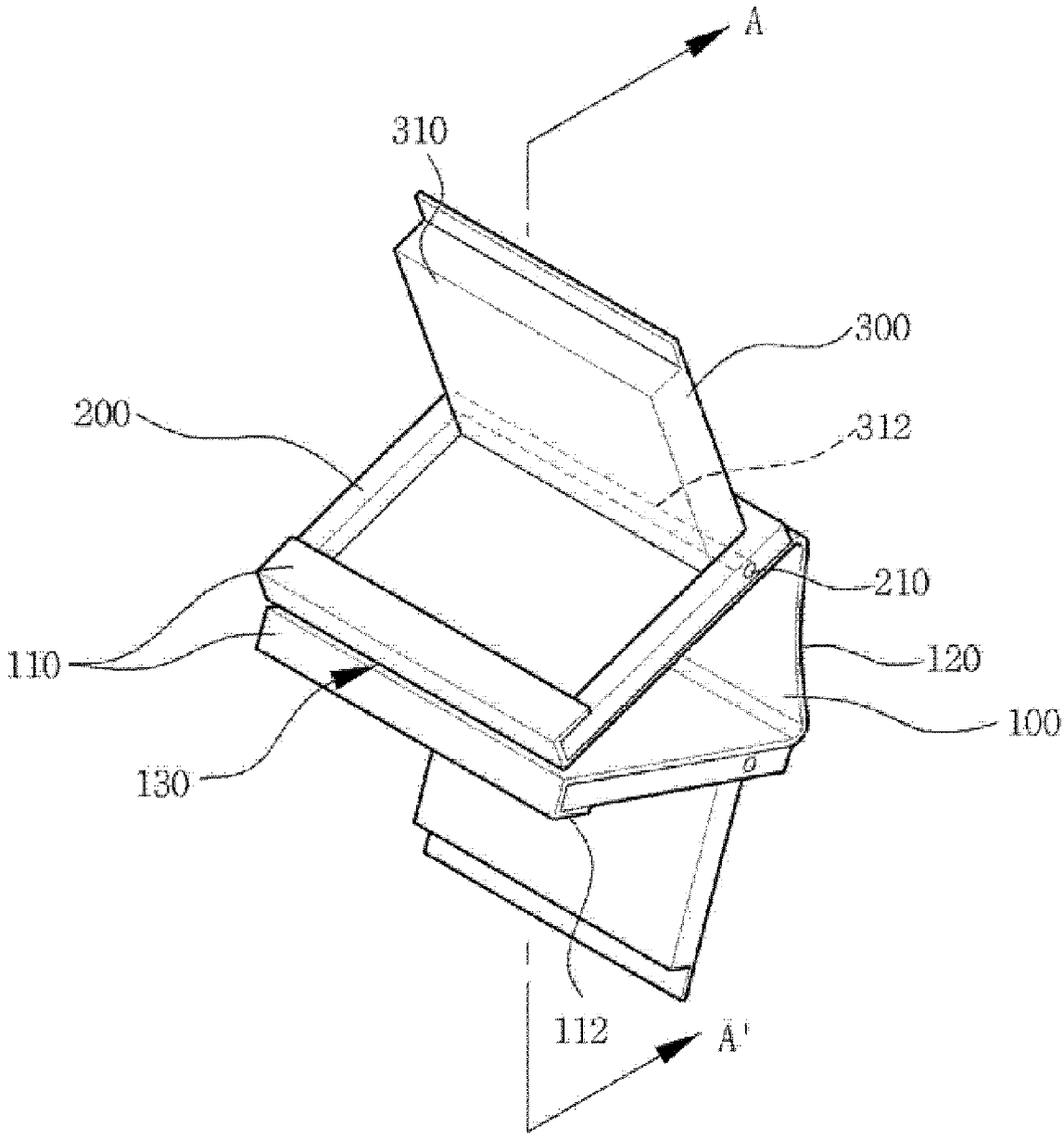
FIG. 3A is a perspective view illustrating the opened state of a hinged pressing lever of the binder clip according to the present invention.
Figure 3B:
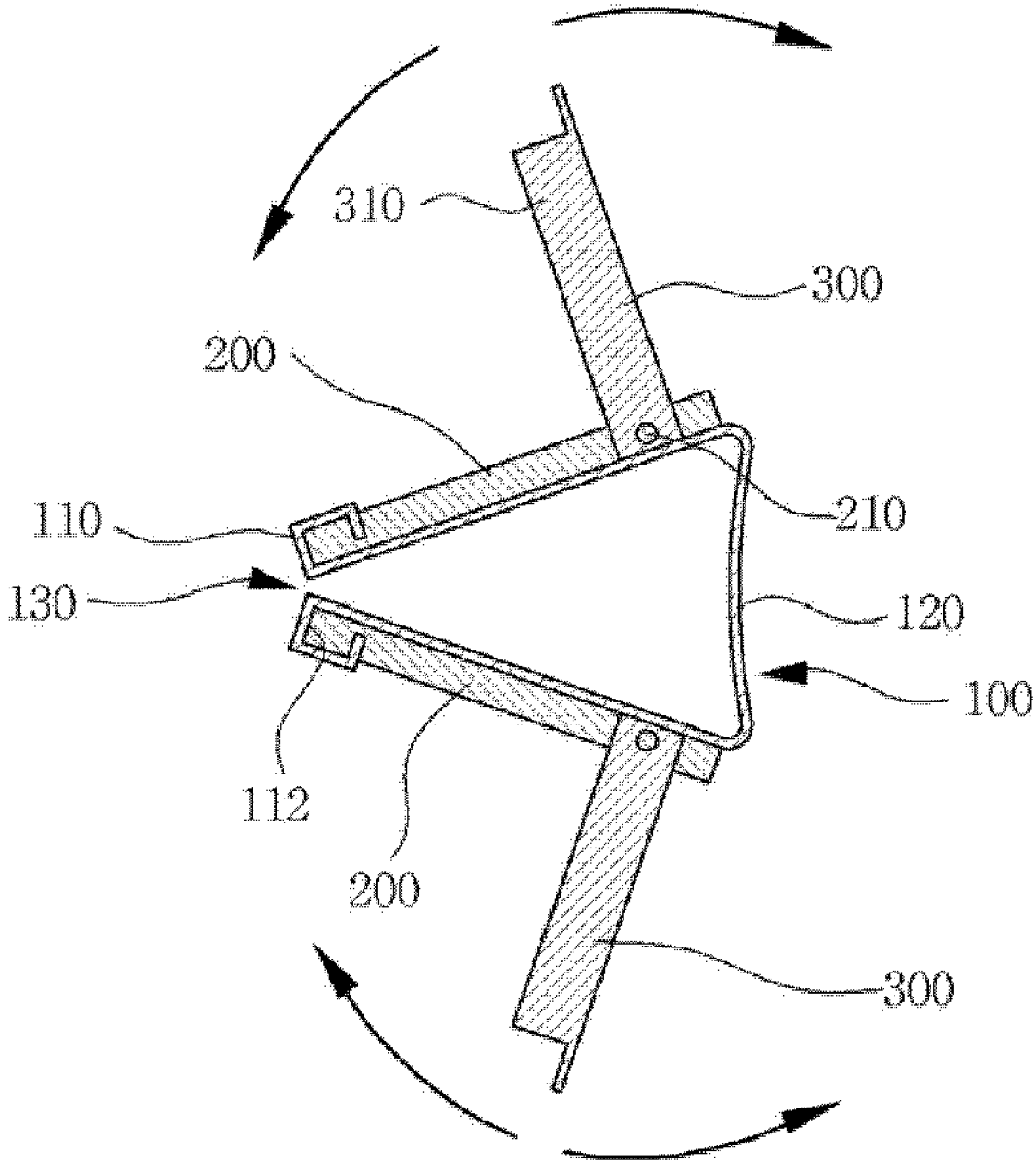
FIG. 3B is a sectional view of the binder clip taken along line A-A' of FIG. 3A.
Figure 4A:
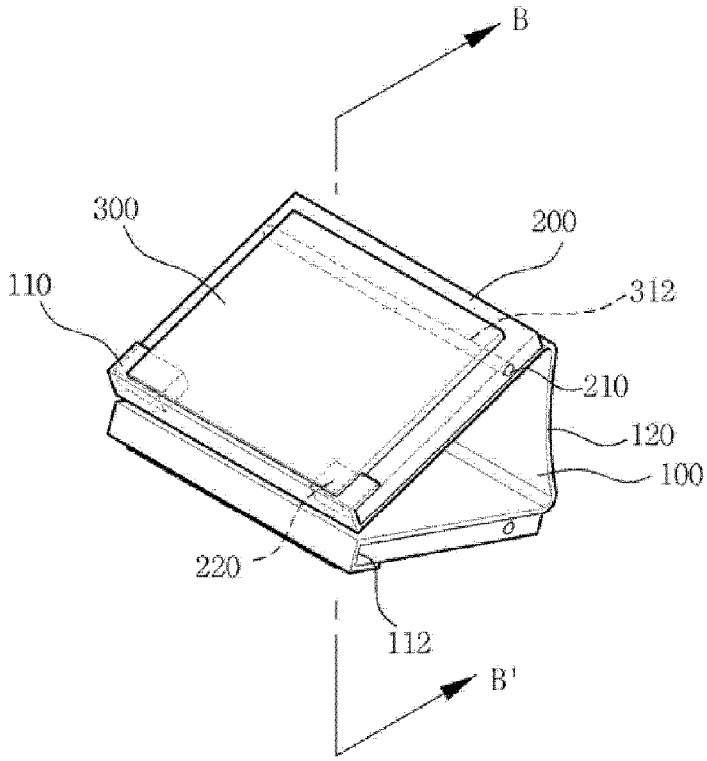
FIG. 4A is a perspective view illustrating the closed state of the hinged pressing lever of the binder clip according to the present invention.
Figure 4B:
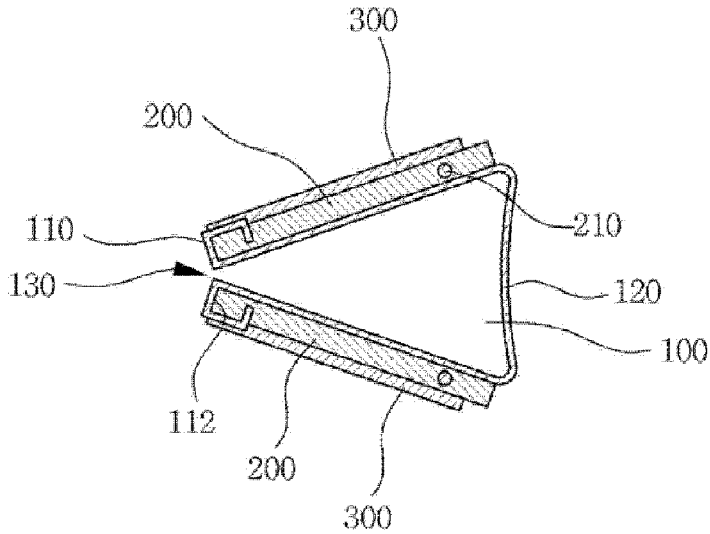
FIG. 4B is a sectional view of the binder clip taken along lone B-B' of FIG. 4A.

FIG. 3A is a perspective view illustrating the opened state of the pressing lever of the binder clip according to the present invention. FIG. 3B is a sectional view of the binder clip taken along line A-A' of FIG. 3A. FIG. 4A is a perspective view illustrating the closed state of the pressing lever of the binder clip according to the present invention. FIG. 4B is a sectional view of the binder clip taken along lone B-B' of FIG. 4A. As shown in FIGS. 3A, 3B, 4A and 4B, if the upper and lower pressing levers 300 of the binder clip 1 are opened and pressed by a user's fingers, the elastic web 120 elastically and inwardly bulges while the mouth 130 is elastically opened.

When the finger's pressing force is removed from the pressing levers 300 after the jaws around the open mouth 130 of the binder clip have been positioned over arranged edges of document sheets, the jaws 110 compress the upper and lower surfaces of the document sheets due to the elasticity of the elastic web 120.

After bounding the document sheets using the binder clip, the plate-type pressing levers 300 are closed to the coupling guides 200, the pressing levers 300 are brought into close contact with the clip body 100 without protruding outwards, so that the binder clip of the present invention is convenient to users when stacking up and keeping a plurality of documents bound by clips in one place.

When the plate-type pressing levers 300 are opened from the respective coupling guides 200, large angles are formed between them. Furthermore, the finger-operated pressing levers 300 are formed as a plate shape having a large surface, so that a user can open the clip by manipulating the pressing levers 300 with a small force without feeling pain in his/her fingers, unlike conventional binder clips.

Figure 5:
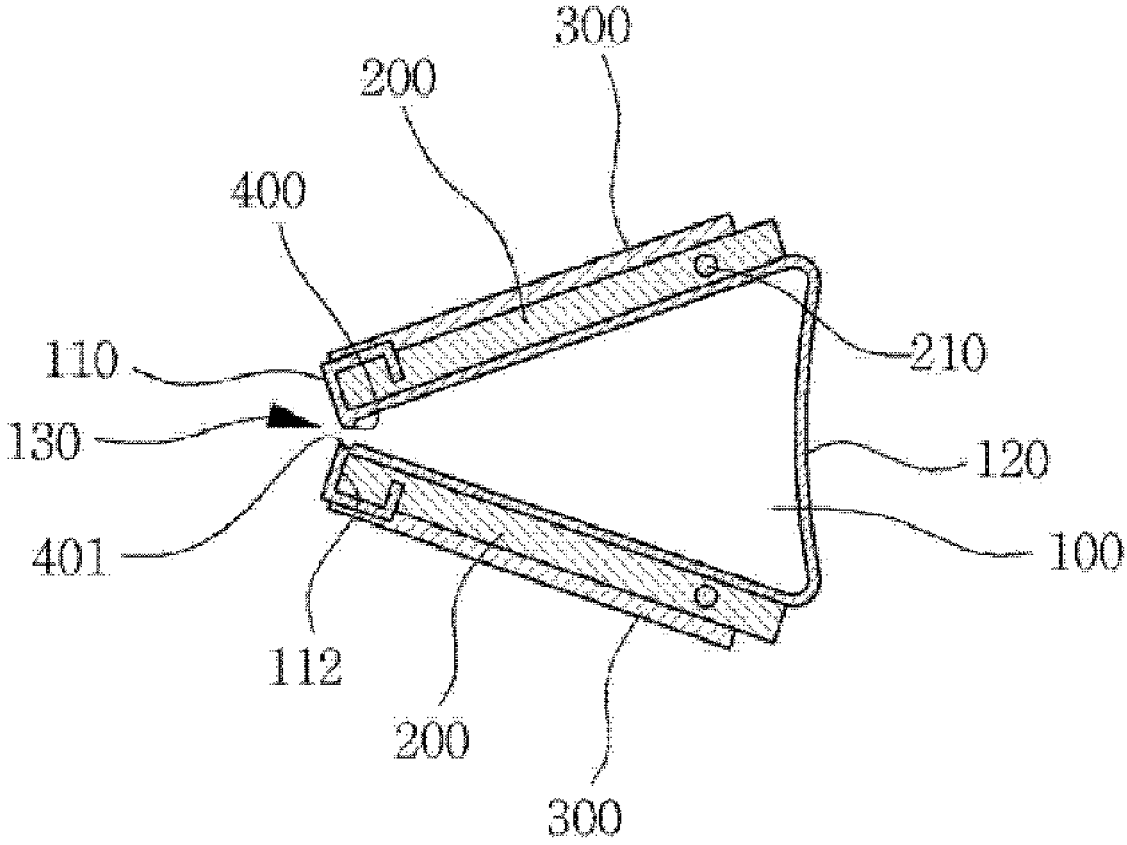
FIG. 5 is a sectional view illustrating the construction of a binder clip having both a clamping protrusion and a clamping groove in its jaws according to a second embodiment of the present invention.

FIG. 5 is a sectional view illustrating the construction of a binder clip according to a second embodiment of the present invention. Unlike the embodiment of FIG. 4B, the binder clip according to the second embodiment has a clamping protrusion 400 and a clamping groove 401 in its jaws 110, thus more efficiently clipping the document due to engagement of the clamping protrusion 400 with the claiming groove 401.

In the present invention, the clamping protrusion 400 may comprise a plurality of hemispherical protrusions which are formed along a line at regular intervals. However, the claiming protrusion 400 is preferably configured as a bar-type protrusion. The clamping groove 401 is sized, shaped and located to correspond to those of the clamping protrusion 400.

As apparent from the above description, the binder clip according to the present invention includes two coupling guides supported on a clip body, and a plate-type pressing lever hinged to each of the coupling guides to be rotatable relative to the guides. In the clip, the pressing lever is configured to not protrude, so that the clip is convenient to users when stacking up and keeping a plurality of documents bound by clips in one place.

Furthermore, the pressing levers can be opened from the respective coupling guides with a large angle between them and are formed as a plate shape having a large surface. Thus, a user can open the jaws of the clip by manipulating the pressing levers with a small force without feeling pain in his/her fingers, unlike conventional binder clips.

In addition, each of the coupling guides and the pressing levers is made of a light material, such as a glass fiber, a carbon fiber or aluminum, thus reducing the weight of the binder clip in comparison with a conventional product.

Furthermore, the binder clip of the present invention has a good appearance that is attractive to users by providing letters, patterns, embossments, perforations, mesh, figures or photographs on the upper and lower surfaces of each plate-type pressing lever.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A binder clip comprising:

a clip body formed by bending a sheet to have a triangular cross-section, comprising open opposite sides, upper and lower jaws respectively having upper and lower pockets at front ends thereof, and an elastic web connected to rear ends of the jaws in order to provide elasticity to the clip body, so that the jaws are levered upwards and downwards by bending strength of the elastic web, thus opening a mouth of the clip body:

a coupling guide formed as a U-shaped frame body having a predetermined thickness and placed outside each of upper and lower surfaces of the clip body, with a locking projection provided at each end of the U-shaped coupling guide in order to be seated in the pocket of an associated jaw, and a pair of hinge holes formed on opposite positions of an inner surface of a rear part of the coupling guide; and a plate pressing lever formed as a plate-shaped body having a hinge hole in one end thereof so that the pressing lever is hinged to the hinge holes of the coupling guide using a hinge pin, thus being rotatable around the hinge pin in order to be opened or closed relative to the coupling guide.

2. The binder clip as set forth in claim 1, wherein the front ends of the upper and lower jaws are angularly bent to form the pockets having a rectangular cross-section; and the coupling guide has a rectangular cross-section having outer surfaces corresponding to inner surfaces of each of the pockets of the clip body.

3. The binder clip as set forth in claim 1, wherein the plate pressing lever further comprises: a thick part provided on a lower surface of the pressing lever and having both a surface area and a thickness corresponding to a space inside the U-shaped coupling guide.

4. The binder clip as set forth in claim 1, wherein the plate pressing lever further comprises: at least one rib provided on a lower surface of the pressing lever and having both a width and a thickness corresponding to a space inside the U-shaped coupling guide.

5. The binder clip as set forth in claim 1, wherein the plate pressing lever is provided on upper and lower surfaces thereof with letters, patterns, embossments, perforations, mesh, figures or photographs.

6. The binder clip as set forth in claim 1, wherein the plate pressing lever is provided with a hanging hole formed vertically through the pressing lever at a predetermined position.

7. The binder clip as set forth in claim 1, wherein the jaws are provided with a clamping protrusion and a clamping groove.

* * * * *